US006338356B1

(12) United States Patent
Wallenstatter

(10) Patent No.: US 6,338,356 B1
(45) Date of Patent: Jan. 15, 2002

(54) PORTABLE TENT

(76) Inventor: Dalaimour Wallenstatter, 1720 NW. North River Dr., #502, Miami, FL (US) 33125

( * ) Notice: Subject to any disclaimer, the term of this patent is extended or adjusted under 35 U.S.C. 154(b) by 0 days.

(21) Appl. No.: 09/563,124

(22) Filed: May 2, 2000

(51) Int. Cl.[7] ..... E04H 15/24

(52) U.S. Cl. ..... 135/100; 135/90; 135/98; 135/119

(58) Field of Search ..... 135/90, 100, 900, 135/115, 116, 117–119, 120.1

(56) References Cited

U.S. PATENT DOCUMENTS

| | | | | | |
|---|---|---|---|---|---|
| 851,429 | A | * | 4/1907 | Noble | 135/90 |
| 1,581,180 | A | * | 4/1926 | Csajaghy | 135/90 |
| 1,692,522 | A | * | 11/1928 | Tlll | 135/90 |
| 2,197,478 | A | * | 4/1940 | Mathieu | 135/90 |
| 3,498,305 | A | * | 3/1970 | Hulin | 135/90 |
| 3,545,461 | A | * | 12/1970 | Carlson | 135/90 |
| 4,284,095 | A | * | 8/1981 | Norton | 135/21 |
| 4,825,578 | A | * | 5/1989 | Robinson | 135/90 |
| 5,218,982 | A | * | 6/1993 | Kenji | 135/90 |
| 5,430,980 | A | * | 7/1995 | Ferrier | 52/63 |
| 5,630,439 | A | * | 5/1997 | Hutto | 135/90 |
| 5,787,914 | A | * | 8/1998 | Greywall | 135/90 |
| 6,145,141 | A | * | 11/2000 | Whittington | 135/90 |

* cited by examiner

*Primary Examiner*—Beth A. Stephan
(74) *Attorney, Agent, or Firm*—Malin, Haley & DiMaggio, P.A.

(57) ABSTRACT

A portable tent having an interior, mesh-like netting portion, and an outer, waterproof canvas covering which may double as a poncho. The tent requires no assembly components other than stakes to affix the bottom of the tent to the ground and a top securing plate which is removably secured to a support object such as a tree limb. The top metal plate has a plurality of fastening rings on its upper and lower sides and is tied to the object situated substantially above the place where the tent is to be erected. A unique flexible support ring is woven into the fabric of the interior netting portion to support the sides of the tent structure. An object such as a cellular telephone or a flashlight may be suspended from an interior suspension ring situated on the bottom side of the plate via twine or string to allow the occupant to conveniently protect valuable or electronic accessories or to provide hands-free illumination from above during tent assembly. The outer, canvas covering conveniently doubles as a waterproof poncho by simply disengaging it from its support fasteners and the support plate. The entire tent, including both inner and outer enclosures may be folded neatly into a carrying case thereby allowing an entire waterproof tent structure to be transported easily and conveniently.

4 Claims, 5 Drawing Sheets

PORTABLE TENT

BACKGROUND OF THE INVENTION

1. Field of the Invention

This invention relates to a portable tent apparatus which may be conveniently secured to an overhead object, be easily assembled without the use of poles and can be folded after use to fit within a small carrying case.

2. Description of Related Art

Camping has become a popular summer outdoor activity. Families flock to beaches and campsites with tents and barbeque equipment to enjoy time away from their homes. Campers need tents to provide adequate shelter from the elements and to comfortably house family members. The typical tent includes a number of interconnecting poles, ropes and stakes. Generally, it takes one person or several people a significant amount of time and effort to assemble the tent. Also, typical tents are heavy, and include parts which may become lost during transport.

Lightweight, portable tents have recently become very popular. The trend is towards tents that require less assembly time, are less expensive and have a longer, even portable tents include poles and other components needed for life. Because families that go camping typically must carry clothes, food, water and other supplies, transporting a large tent and all of its associated components adds significantly to their load.

However assembly. After unloading all of their supplies, campers may discover that some poles or ropes or stakes are missing from their kit making it difficult if not impossible to properly assemble their tent.

Attempts have been made to design a simple, easy-to-assemble, portable tent. U.S. Pat. No. 4,793,371 issued to O'Ferell, et al. describes a portable tent using tubular elements which are fitted together to form a roof, a frame with four leg portions extending downward to form a free-standing structure, and leg panels attached to the leg portions to provide tension in order to hold the tent frame in place. However, O'Ferrell is comprised of many components, including rigid pole connectors and hooks.

U.S. Pat. No. 4,5119,410 issued to Kubacki discloses a portable tent having an outer enclosure comprised of see-through "mosquito netting" material completely enclosing an inner waterproof canvas tent which can be erected by an occupant from within the outer tent. However, Kubacki utilizes aluminum frames secured by guy-lines, stakes and pegs to support the structure.

U.S. Pat. No. 5,218,982 issued to Kenji discloses a portable tent suspended above the ground on a tree using stanchions and ropes to support a tent support frame.

However, none of these patents include the unique features of the present invention. Each of these patents include components such as ropes, stanchions, and pegs and require extensive assembly time.

Accordingly, what is needed in the art is a portable tent capable of being assembled anywhere near an object of suitable dimensions, which can be assembled quickly and easily by one person and has no component parts other than tent-securing stakes and a support plate, and which can be folded neatly and compactly into an over-the-shoulder carrying case, after use.

What is also needed is a portable tent with an inner see-through mesh inner portion and a waterproof outer tent covering that, in the alternative, may conveniently be used as a waterproof poncho.

It is, therefore, to the effective resolution of the aforementioned problems and shortcomings of the prior art that the present invention is directed.

BRIEF SUMMARY OF THE INVENTION

The present invention provides a portable tent which can be easily assembled without the use of poles or ropes and that folds up conveniently into the size of a bag easily carried by a shoulder strap.

The invention comprises a small circular metal support plate which has a securing ring in the center of its top, exterior face, and a number of similar rings disposed along the plate's bottom surface. The top, exterior ring allows for material such as ribbon or nylon material of sufficient strength to be wrapped around a sturdy object like a tree limb or branch substantially above where the tent is to be placed and tied to the ring. The material may be secured to the top ring via a knot and then looped around the sturdy object and secured thereto by similar means.

An interior housing portion comprised of a see-through netting material is removably secured to the plate. The netting material includes a plurality of tying strips at its top. These strips are secured to the bottom, underside of the plate by tying each strip around one of the plate's bottom rings.

The netting material may be secured to the ground via a plurality of stakes. The netting material can be stretched and extended to its maximum length prior to securing its lower corners to the ground via the stakes. This provides enough interior space within the netting material to comfortably fit a family. The netting includes a zipper running down the center of its front face which allows one to easily enter and exit the tent structure after it has been assembled.

The interior tent housing also includes a canvas portion along its bottom and lower edges. The canvas material comprises the floor of the tent and its lower sides. The canvas material is waterproof and prevents water and moisture from entering the interior of the tent.

Near the top of the netting material is a substantially annular wire support ring affixed to the netting. After the stakes have been inserted into the ground and the interior tent housing has been erected, the annular ring acts as a ceiling support to the tent structure, provides support to the tent walls and prevents the sides of the netting material from collapsing inwards. The ring allows the tent structure to provide maximum interior space. Without the ring, the upper and side portion of the tent structure would bend inwards, therefore, eliminating a significant amount of interior area.

The invention also includes a waterproof, outer canvas covering which may be secured to the support plate in the same fashion as described above for the netting material. It can be secured to the remaining, unused fastening rings of the bottom side of the support plate or tied to the same rings of the plate used to secure the inner netting portion of the tent.

The outer canvas covering encloses the inner netting portion, and protects the inhabitants of the tent from rain and other elements. The outer canvas material may include one or more windows, window coverings, window covering straps, and a means of egress such as a zipper. The outer portion is placed over the netting, stretched to its maximum capacity and secured to the ground at its lower ends by either the existing stakes or separate stakes.

One of the novel features of the invention is the multiple uses of the outer canvas material. If the user wishes, he or she may utilize the outer waterproof canvas portion as a poncho, which includes a hood portion, and tightening strings, all comprised of the existing canvas material and its window securing strings. The outer covering may be simply untied from the support plate fasteners and wrapped around the user.

The bottom, underside of the support plate also includes a central suspension ring. Rope or any suitable material may be looped around the ring and then secured to a small device such as a cellular telephone or a flashlight. Thus, a flashlight can be suspended from the center ring to provide light to the user at night. Should moisture seep into the tent at night, a cellular telephone or other electrical devices can remain dry by simply keeping them suspended and tied around the support plate's central suspension ring.

Therefore, it is an object of the present invention to provide a portable tent that can be quickly assembled without the use of poles, ropes or pegs.

It is another object of the present invention to provide a portable tent that can be conveniently folded into a small bag after use capable of being transported by one person, yet large enough to comfortably house a family, after assembly.

It is yet another object of the present invention to provide a portable tent having an outer, waterproof covering portion which can also be used as a poncho.

In accordance with these and other objects which will become apparent hereinafter, the instant invention will now be described with particular reference to the accompanying drawings.

DETAILED DESCRIPTION OF THE INVENTION

Figure 1:
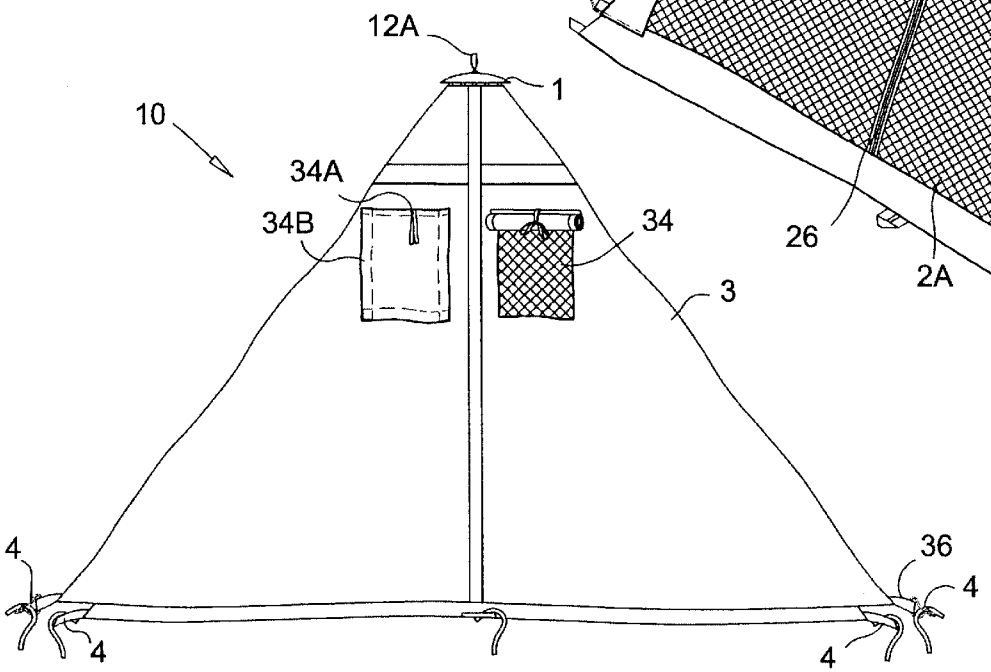
FIG. 1 shows a front view of the portable tent of the present invention after assembly.

Referring to FIG. 1, the portable tent 10 of the present invention is shown, including a top support plate 1, an outer tent covering portion 3 comprised of a waterproof canvas material, stakes 4 embedded in the ground, securing loops 36, windows 34, window coverings 34B, window securing means 34A, and top securing strip 12A. Window securing means 34A may be rope, string, or any suitable material and is used to secure window coverings 34B to allow light to enter the tent and to allow the user within the tent to see outside via window 34. FIG. 1 shows portable tent 10 after assembly. The tent has been zippered shut and is firmly secured to the ground via stakes 4 and secured above to an object (not shown) via top securing strip 12A.

Figure 2:
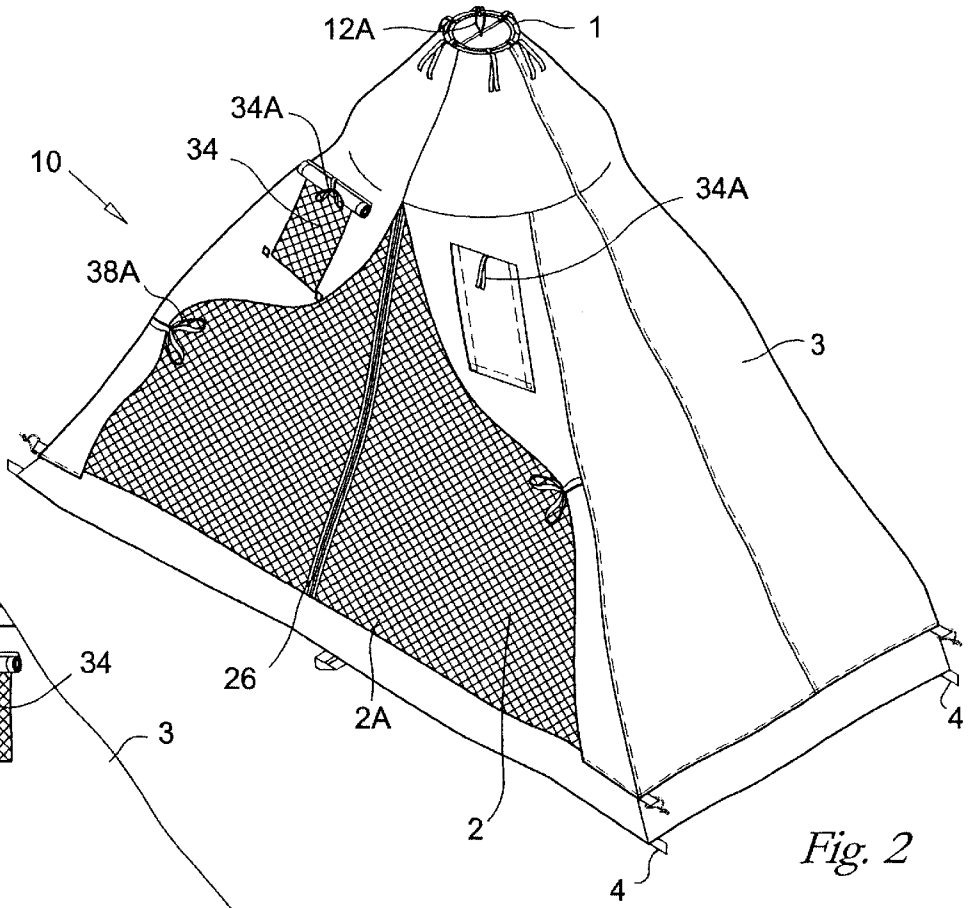
FIG. 2 shows a perspective side view of the portable tent with the outer canvas covering folded back to reveal the inner, netting material.

FIG. 2 shows portable tent 10 with waterproof outer material 3 partially folded back and secured via securing means 38A to reveal the inner portion of tent 10, comprised of a see-through meshed netting portion 2. Zipper 26 is shown in a closed position. Window 34 is opened and window covering 34B secured via window securing means 34A. Tent 10 reaches a maximum height of 190 cM, a length measured from one front corner of the tent to the other front corner, of 210 cM, and a width measured from the front to the back of the tent, of 90 cM. Along the bottom of tent 10 is lower portion 2A which is comprised of waterproof canvas material and comprises the lower portion of netting 2. Lower portion 2A is comprised of waterproof canvas material and forms the floor and lower walls of tent 10. Securing loops 36 are affixed around the perimeter of lower portion 2A and are looped around stakes 4, which are embedded in the ground.

Figure 3:
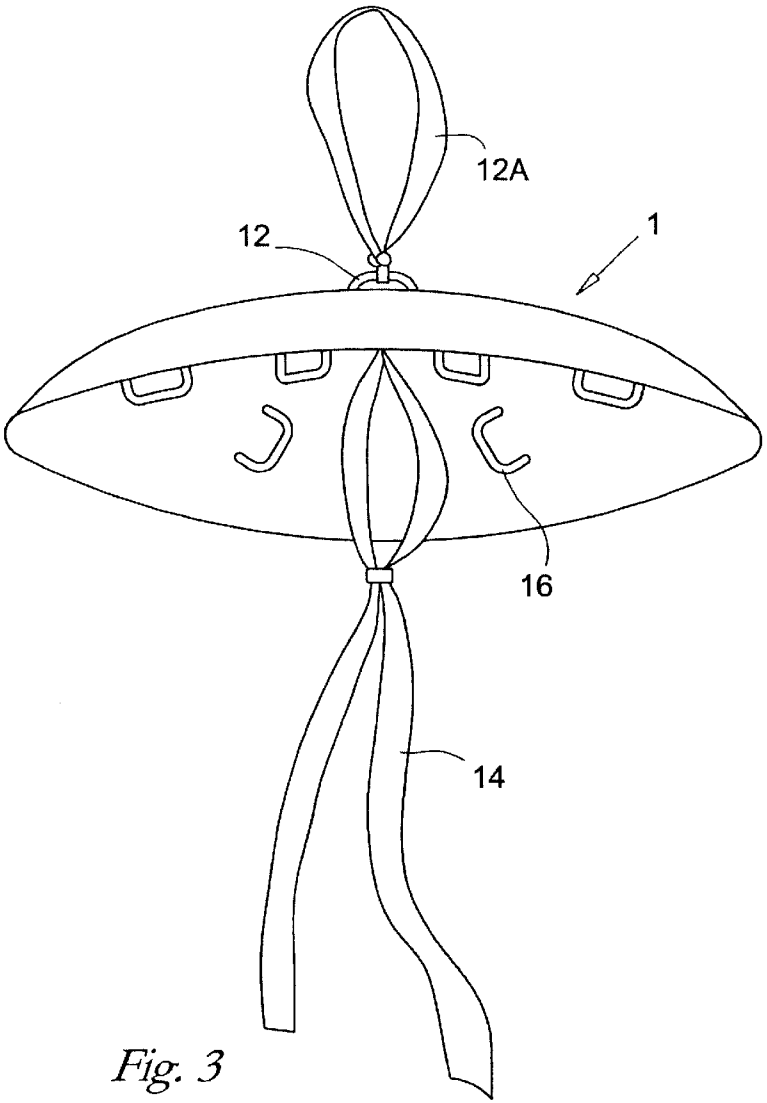
FIG. 3 shows the top support plate with an exterior support ring, a plurality of interior support rings and both upper and lower fastening means.

FIG. 3 shows support plate 1 having a plurality of interior rings 16 protruding from the bottom, underside of plate 1. Securing material 12A may be affixed to exterior ring 12 to removably secure tent 10 to an object substantially above the location where the tent is to be erected. The object may be, for example, a low-hanging tree branch, a protruding oblong-shaped rock, or an extending portion of a building. Material 12A must be of sufficient strength to support the weight of tent 10, which is approximately 1.8 kgs.

Securing strip 14 hangs down below plate 1 inside of tent 10 from a centrally-placed suspension ring. During or after assembly, objects such as flashlights, cameras, or cellular telephones can be suspended by strip 14, providing a safe, convenient location for the object. This is of particular importance during nighttime assembly. A flashlight suspended from the suspension ring via strip 14 can provide hands-free illumination during tent assembly.

Figure 4:
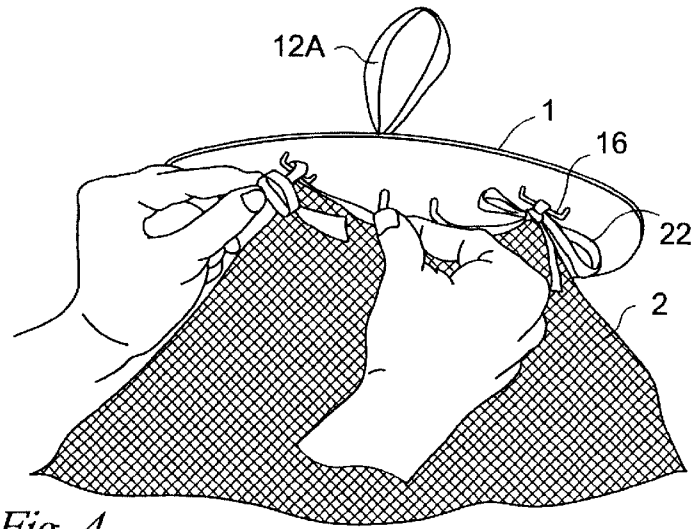
FIG. 4 shows a method of securing the interior netting portion of the portable tent to the bottom fastening rings of the support plate.
Figure 5:
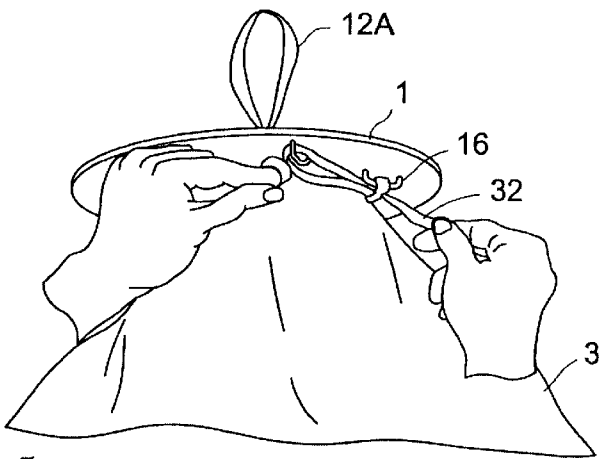
FIG. 5 shows a method of securing the exterior canvas portion of the portable tent to the bottom fastening rings of the support plate.

FIG. 4 shows a method used to secure netting portion 2 to plate 1. After plate 1 has been secured to an object such as a tree limb via material 12A, the top of netting portion 2 is secured to plate 1 by looping and tying a plurality of nylon strips 22, situated at the top of netting 2 around rings 16. Rings 16 are situated around the periphery of the underside of plate 1. Canvas portion 3 is secured to plate 1 in the same manner, as shown in FIG. 5. This is done after interior netting 2 has been completely erected. Connecting material 32 may then be looped around the remaining, unused rings 16 of plate 1 or may also be secured to the rings 16 already being utilized to secure the top of netting portion 2.

Figure 6:
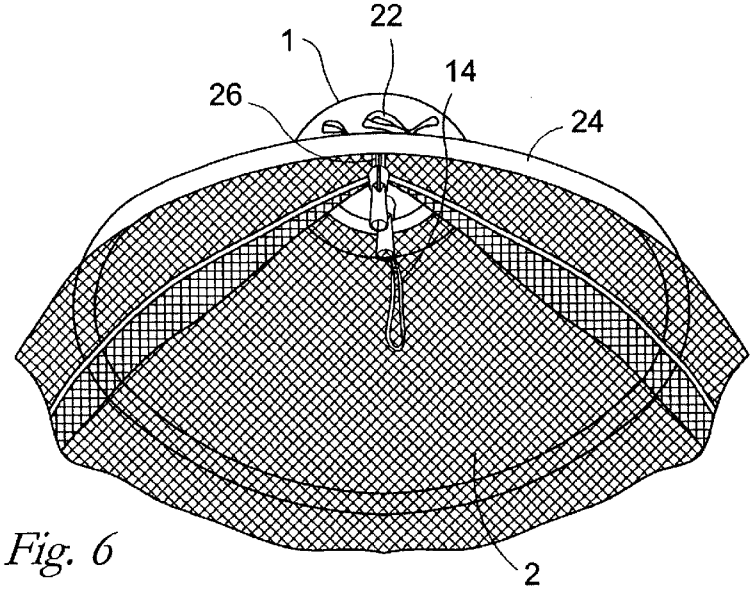
FIG. 6 shows a bottom perspective view of the portable tent looking upwards towards the top interior of the tent.
Figure 7:
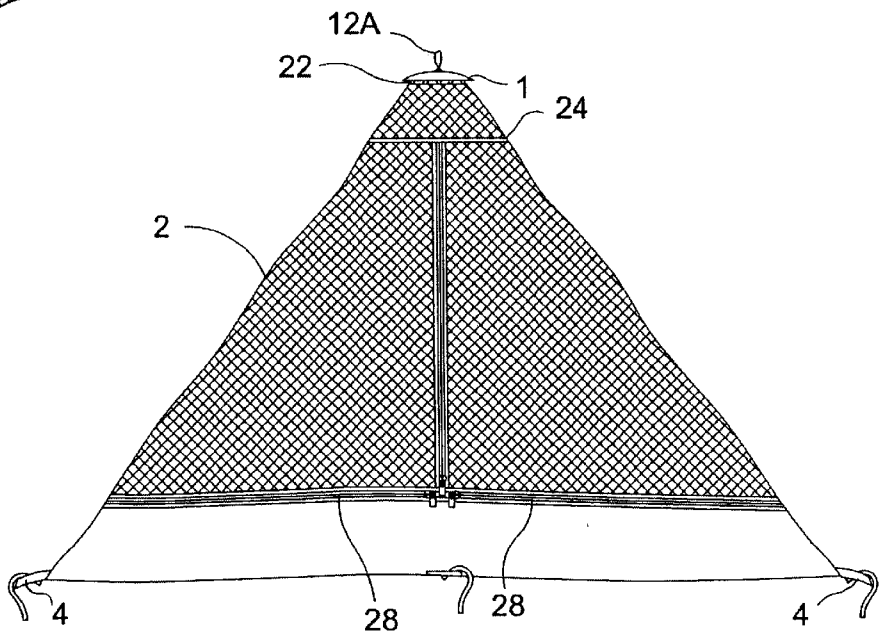
FIG. 7 shows a front view of the portable tent after assembly without the outer canvas covering.
Figure 9:
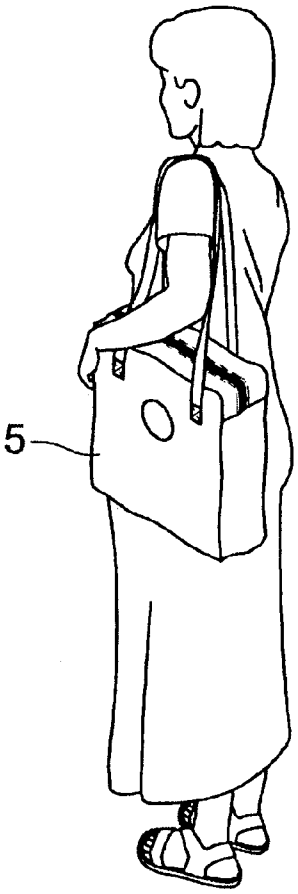
FIG. 9 shows the portable tent being stored in an over-the-shoulder carrying bag.

FIG. 6 shows portable tent 10, including netting 2, from within the interior of the assembled tent, looking up towards the top of the tent. Support plate 1 can be clearly seen as can securing strip 14 hanging down from the underside of plate 1. A support ring 24 is woven into the fabric towards the top of netting 2. FIG. 7 more clearly depicts ring 24 as it encircles tent 10 and supports the sides of tent 10 in a sturdy, upright configuration. Ring 24 is made of an easily-flexible wire and yet is sturdy enough to maintain its annular orientation after nylon strips 22 have been secured to interior rings 16. Support ring 24 maintains the sides of the tent at an angled configuration thereby providing maximum interior space. The wire comprising ring 24, however, is of sufficient flexibility to be bent to allow the entire tent structure to fit within a small carrying case 5 capable of being easily carried by one person, as seen in FIG. 9 and of sufficient and resiliency to be re-used over and over again.

Figure 8:
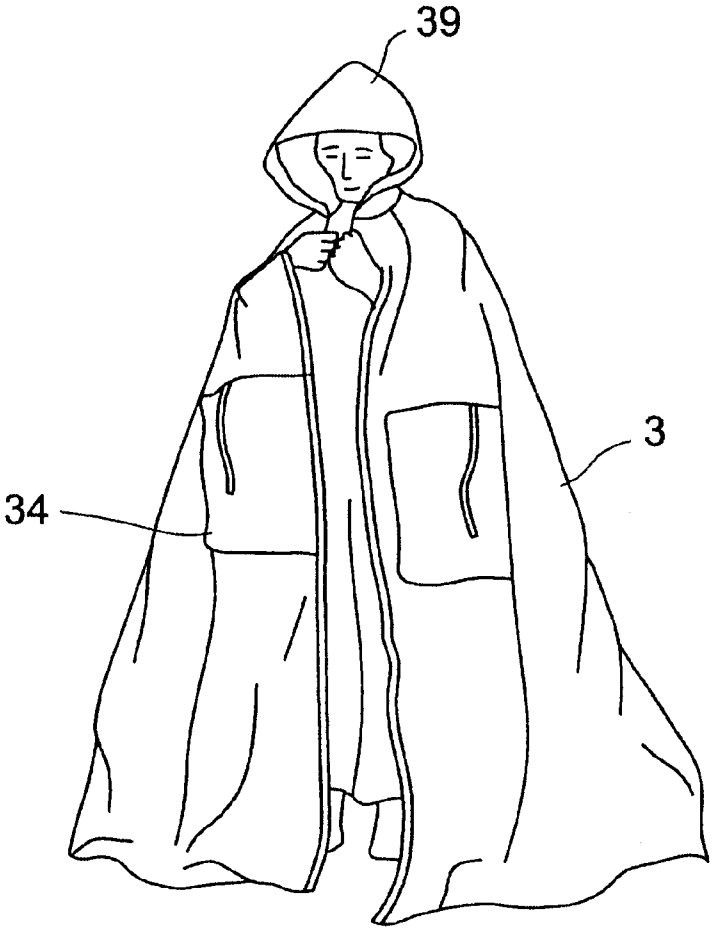
FIG. 8 shows an alternate use of the outer canvas portion of the portable tent.

One of the many unique features of the present invention is the multiple use of outer canvas covering portion 3. Outer canvas portion 3 may be used as a waterproof poncho, as shown in FIG. 8. The poncho includes hood 39. Connecting material 32 may be used to tighten hood 39 around the head of the user. By simply removing outer portion 3 from rings 16, the outer covering may be wrapped around the body of the user to provide protection in inclement weather.

Figure 10:
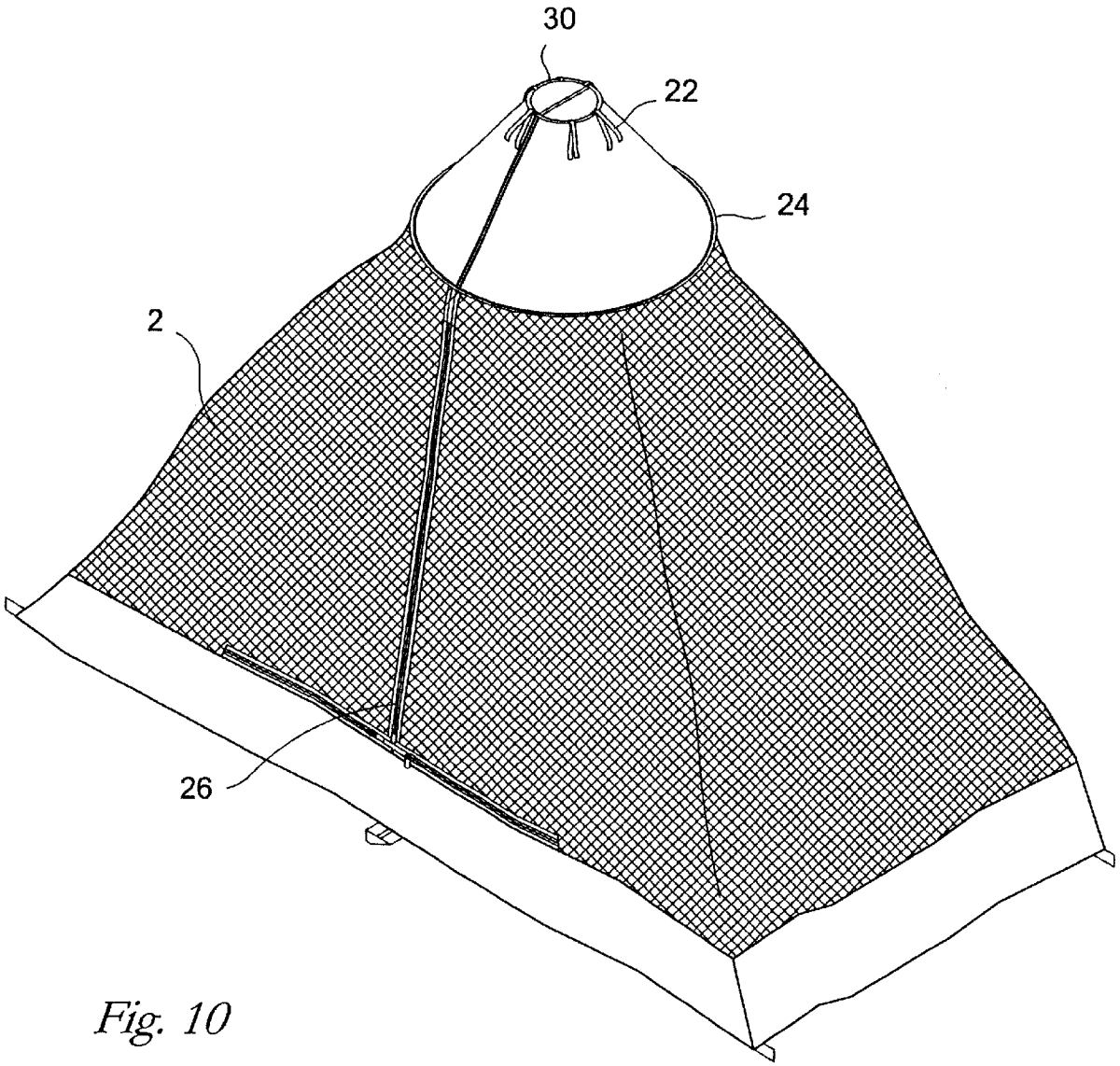
FIG. 10 shows a perspective view of the portable tent of the present invention after assembly, without the outer, canvas covering.

FIG. 10 shows portable tent 10 after assembly, without, or after removal of, outer portion 3. Interior netting material 2 is secured via zipper 26. Annular ring 24 can be seen towards the top portion of netting 2. Nylon strips 22 are affixed to a circular pad 30 which forms the top of inner portion 2. Strips 22 are sewn into the material around the periphery of pad 30, in pairs. Each pair of strips are then looped and tied around fastening rings 16.

Support ring 24 actually forms a dome at the top of tent 10, and supports the side walls of the tent in order to provide maximum interior space.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A portable tent comprising:

a securing plate for mounting on an object, said plate having a plurality of interior fastening means disposed around a bottom surface of said plate, and exterior fastening means disposed about a top surface of said plate wherein said interior and said exterior fastening means are rings protruding from said plate;

an interior tent portion of netting material removably secured to said securing plate, said netting material includes a plurality of tying strips protruding from a top portion of said netting material which are removably secured to said interior fastening means thereby supporting said tent, said interior tent portion including a substantially annular support ring affixed to said netting material to provide lateral support to said tent and to maximize the interior area of said tent;

said interior tent portion including a means of egress to allow for entrance to and exit from said tent, said means of egress being a zipper, and a lower canvas portion to comprise a floor and lower walls of said tent;

means to secure said tent to the ground;

a waterproof outer tent portion of canvas material to envelop said interior tent portion wherein said outer tent portion is secured to said plate via said interior fastening means, includes window openings and a frontal means of egress and may be disengaged from said plate and used as a waterproof poncho; and central suspension means protruding from the bottom surface of said plate to suspend small objects such as a cellular telephone or a flashlight.

2. A portable tent to be supported from above by an object, said tent comprising:

a securing plate having a top and a bottom surface, said plate having a plurality of interior fastening means disposed around said bottom surface of said plate, and one or more exterior fastening means disposed about said top surface;

an interior tent portion of meshed netting material removably secured to said securing plate, said meshed netting material includes a plurality of tying strips protruding from the top portion of said netting material which affix to said interior fastening means;

said interior tent portion including a means of egress;

a substantially annular support ring affixed to said netting material to support sides of said interior tent portion; and means to secure said tent to the ground.

3. A portable tent comprising:

a securing plate having a top and a bottom surface for mounting on an object, said plate having a plurality of fastening rings disposed around said bottom surface of said plate, and one or more exterior fastening rings disposed about said top surface to be secured to said object situated above said tent;

an interior tent portion of meshed netting material removably secured to said securing plate, said meshed netting material includes a plurality of tying strips protruding from the top portion of said netting material which affix to said interior fastening means;

said interior tent portion including a zipper to allow for entrance to and exit from said tent;

a substantially annular support ring affixed to said netting material to provide lateral support to said tent and to maximize the interior area of said tent;

a plurality of securing stakes;

an outer tent portion of canvas material to envelop said interior tent portion wherein said outer tent portion is secured to said plate via said interior fastening means and said outer tent portion includes window openings and a frontal means of egress;

said outer tent portion may be disengaged from said plate and used as a waterproof poncho;

said interior tent portion further comprises a lower canvas portion; and a central suspension ring protruding from said bottom surface of said plate to suspend small objects such as a cellular telephone or a flashlight.

4. A method of assembling a portable tent comprising the steps of:

mounting a plate to an object, said plate having a plurality of interior fastening means disposed around the bottom surface of said plate, and one or more exterior fastening means disposed about the top surface;

securing an interior tent portion made of meshed netting material to said securing plate, said meshed netting material includes a plurality of tying strips protruding from the top portion of said netting material which are removably secured to said interior fastening means, said netting material including a substantially annular support ring to provide lateral support to said tent and to maximize the interior area of said tent;

providing a means of egress in said inner tent portion to allow for entrance to and exit from said tent;

stretching said interior tent portion to its maximum length;

placing a plurality of securing stakes in the ground;

securing each lower corner of said netting material to said plurality of stakes;

affixing an outer canvas covering to said interior fastening means whereby said outer canvas covering envelops said interior tent portion;

stretching said canvas covering to its maximum length; and securing each lower corner of said canvas covering to said stakes.

* * * * *